US008605931B2

(12) United States Patent
Amsel

(10) Patent No.: US 8,605,931 B2
(45) Date of Patent: Dec. 10, 2013

(54) COMBINED HEADPHONE SET AND PORTABLE SPEAKER ASSEMBLY

(76) Inventor: Allan Amsel, Ocean, NJ (US)

( * ) Notice: Subject to any disclaimer, the term of this patent is extended or adjusted under 35 U.S.C. 154(b) by 146 days.

(21) Appl. No.: 13/337,667

(22) Filed: Dec. 27, 2011

(65) Prior Publication Data

US 2012/0093351 A1 Apr. 19, 2012

Related U.S. Application Data

(63) Continuation of application No. 11/651,831, filed on Jan. 10, 2007, now Pat. No. 8,085,966.

(51) Int. Cl.
*H04R 25/00* (2006.01)

(52) U.S. Cl.
USPC ..... 381/370; 381/85; 381/335; 381/366; 381/367; 381/374; 381/376; 381/378; 381/379; 381/383

(58) Field of Classification Search
None
See application file for complete search history.

(56) References Cited

U.S. PATENT DOCUMENTS

| | | | | |
|---|---|---|---|---|
| 2006/0233388 | A1* | 10/2006 | Liow et al. | 381/74 |
| 2007/0258614 | A1* | 11/2007 | Langberg | 381/379 |
| 2009/0041267 | A1* | 2/2009 | Lee et al. | 381/104 |
| 2011/0002478 | A1* | 1/2011 | Pollard et al. | 381/74 |
| 2011/0235819 | A1* | 9/2011 | Alden | 381/77 |
| 2013/0101131 | A1* | 4/2013 | Lin | 381/74 |

* cited by examiner

*Primary Examiner* — Curtis Kuntz
*Assistant Examiner* — Ryan Robinson
(74) *Attorney, Agent, or Firm* — Ezra Sutton

(57) ABSTRACT

A combined headphone set including a speaker assembly. The headphone set includes a headband having a speaker headphone on opposing ends of the headband. Each of the speaker headphones includes an exterior speaker for public listening and an interior speaker for personal listening by the user. One of the speaker headphones includes switching means for listening to the interior speaker or to the exterior speaker or to the interior and exterior speakers simultaneously from each of the speaker headphones. Each of the speaker headphones includes an audio signal wire connected from an output jack of an audio device to the speaker headphones.

14 Claims, 15 Drawing Sheets

COMBINED HEADPHONE SET AND PORTABLE SPEAKER ASSEMBLY

RELATED APPLICATION

This application is a continuation of parent application Ser. No. 11/651,831 filed on Jan. 10, 2007.

FIELD OF THE INVENTION

The present invention relates to a combined headphone set having speaker headphones, wherein each of the speaker headphones has two speakers and both the left and right sides of the headphones have internal and external speakers. More particularly, each of the speaker drivers are positioned in a back-to-back placement, such that one speaker is for personal listening and the second speaker is for public listening.

BACKGROUND OF THE INVENTION

Headphone sets are conventional methods for a listener to personally listen to sounds, music, voices and other miscellaneous acoustical signals. In using a headset, the listener listens to the acoustical signal such that the headphone speakers send a localized or personal acoustical signal to the user's ears, without disturbing other non-listeners. The prior art has combined speakers with a headphone set, such that the speakers can be used with a television, a computer, an audio player device, a stereo and the like, or with the headphone set by itself such that headphones are used with audio player devices, a television, a computer, a stereo and the like. Such combinations tend to be bulky, overly complicated, and not readily usable in its present format.

There are no headphone sets with speaker headphones for each ear wherein each headphone includes two connected speakers being positioned in a back-to-back structure such that an interior ear speaker is used for personal listening and an exterior speaker is used for public listening.

There remains a need for a combined headphone set having speaker headphones wherein each speaker headphone includes an interior ear speaker for personal listening and an exterior speaker for public listening, where each speaker is in a back-to-back configuration. Also needed is the ability to switch the same interior ear speaker drivers from a personal listening mode to the exterior speakers being in a public listening mode or both, with this switching being done in a faster, more convenient manner. Further, the combined headphone set with speaker headphones would require a minimal amount of storage space on a desk, in a drawer, or on a shelf, which greatly adds to both the portabililty factor, as well as negating the need to carry a separate pair of portable speakers.

DESCRIPTION OF THE PRIOR ART

Headphone sets, stand-alone speakers and a combination speaker and earphone apparatus and the like having various designs, configurations, structures and materials of construction have been disclosed in the prior art. For example, U.S. Pat. No. 6,104,819 to NICKUM discloses an audio apparatus which combines a speaker and an earphone. The audio apparatus includes a primary speaker and a secondary speaker. The primary speaker includes a detachably connected headphone set having a headband and secondary speakers connected to the headband. This prior art patent does not teach or disclose the design, configuration and structure of a combined headphone set having each speaker headphone with back-to-back speakers of the present invention.

U.S. Pat. No. 6,483,925 to SHEN discloses a headphone having several speakers. The headphone includes at least three speakers. Two of the speakers are held to the ears and the other speaker is in contact with parts of the head other than the ears so that sound from the speakers is audible by the ears. A signal line having a conductor and a power line are both coupled to each speaker so that external signals are sent to the speakers through the conductor and an external electrical power of source is applied to the speakers through the power line respectively. This prior art patent does not teach or disclose the design, configuration and structure of a combined headphone set having each speaker headphone with back-to-back speakers of the present invention.

U.S. Pat. No. 6,817,440 to KIM discloses multi-channel headphones having at least two speaker units for each ear piece, each for generating distinct sounds from multiple channels; and at least two enclosures in each of which each of the at least two speaker units are installed. The multi-channel headphones include a sound guide portion in each of the enclosures to guide the sound emanating from the corresponding speaker unit into the listener's ear. This prior art patent does not teach or disclose the design, configuration and structure of a combined headphone set having each speaker headphone with back-to-back speakers of the present invention.

U.S. Pat. No. 5,684,879 to VERDICK discloses a combination head mounted speaker assembly and multi-channel audio processing system includes a pair of speaker assemblies mounted at the ends of a pair of extension arms. The arms are mounted on a headband worn on a user's head, so that the speakers in the assemblies are suspended several inches away from either side of the head. The speaker assemblies are also spaced above the shoulders so that the user can maintain the ability to turn his or her head. The speakers are connected via a cable to an eight channel audio processing system, which can deliver eight discreet audio sources into each of the eight speakers, four on each side of the head. This prior art patent does not teach or disclose the design, configuration and structure of a combined headphone set having each speaker headphone with back-to-back speakers of the present invention.

None of the aforementioned prior art patents disclose or teach a combined headphone set having speaker headphones, wherein each of the speaker headphones include an interior ear speaker and an exterior speaker being in a back-to-back placement, as well as a ring stand for positioning each of the speaker headphones on a flat surface for listening to the exterior speakers when in the public listening mode.

Accordingly, it is an object of the present invention to provide a combined headphone set that has speaker headphones, such that each speaker headphone includes an interior ear speaker for personal listening and an exterior speaker for public listening, wherein each speaker is in a back-to-back configuration.

Another object of the present invention is to provide a combined headphone set that has speaker headphones, such that each speaker headphone includes an interior ear speaker for personal listening and a detachable exterior speaker for public listening, wherein each speaker is in a side-by-side configuration.

Another object of the present invention is to provide a combined headphone set that has a pair of speaker headphones that separate from the headband on the headphone set having detachable connection means on each of the speaker headphones.

Another object of the present invention is to provide each of the speaker headphones with a three-way switch for listening to the interior speaker or to the exterior speaker or to the interior and exterior speakers simultaneously from each of the speaker headphones.

Another object of the present invention is to provide each of the speaker headphones having an audio signal wire being connected from an output jack of an audio device to an input jack of each of the speaker headphones.

Another object of the present invention is to provide a combined headphone set having a pair of speaker headphones in use with a headband.

Another object of the present invention is to provide a combined headphone set having a pair of speaker headphones in use with a portable ear-bud headphone(s), or a clip-on style headphone(s).

Another object of the present invention is to provide a combined headphone set that requires a minimal amount of storage space on a desk, in a drawer, or on a shelf.

A further object of the present invention is to provide a combined headphone set that can be mass-produced in an automated and economical manner and is readily affordable by the consumer.

SUMMARY OF THE INVENTION

In accordance with the present invention, there is provided a combined headphone set having speaker headphones. The headphone set includes a headband having a speaker headphone assembly on opposing ends of the headband. Each of the speaker headphone assemblies includes an exterior speaker for public listening and an interior speaker for personal listening by the user. One of the speaker headphone assemblies includes a switching means for listening to the interior speaker or to the exterior speaker or to the interior and exterior speakers simultaneously from each of the speaker headphone assemblies. One of the speaker headphone assemblies includes an audio signal wire connected from an output jack of an audio device to the speaker headphone assembly.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE EMBODIMENTS

First Embodiment 10

Figure 1:
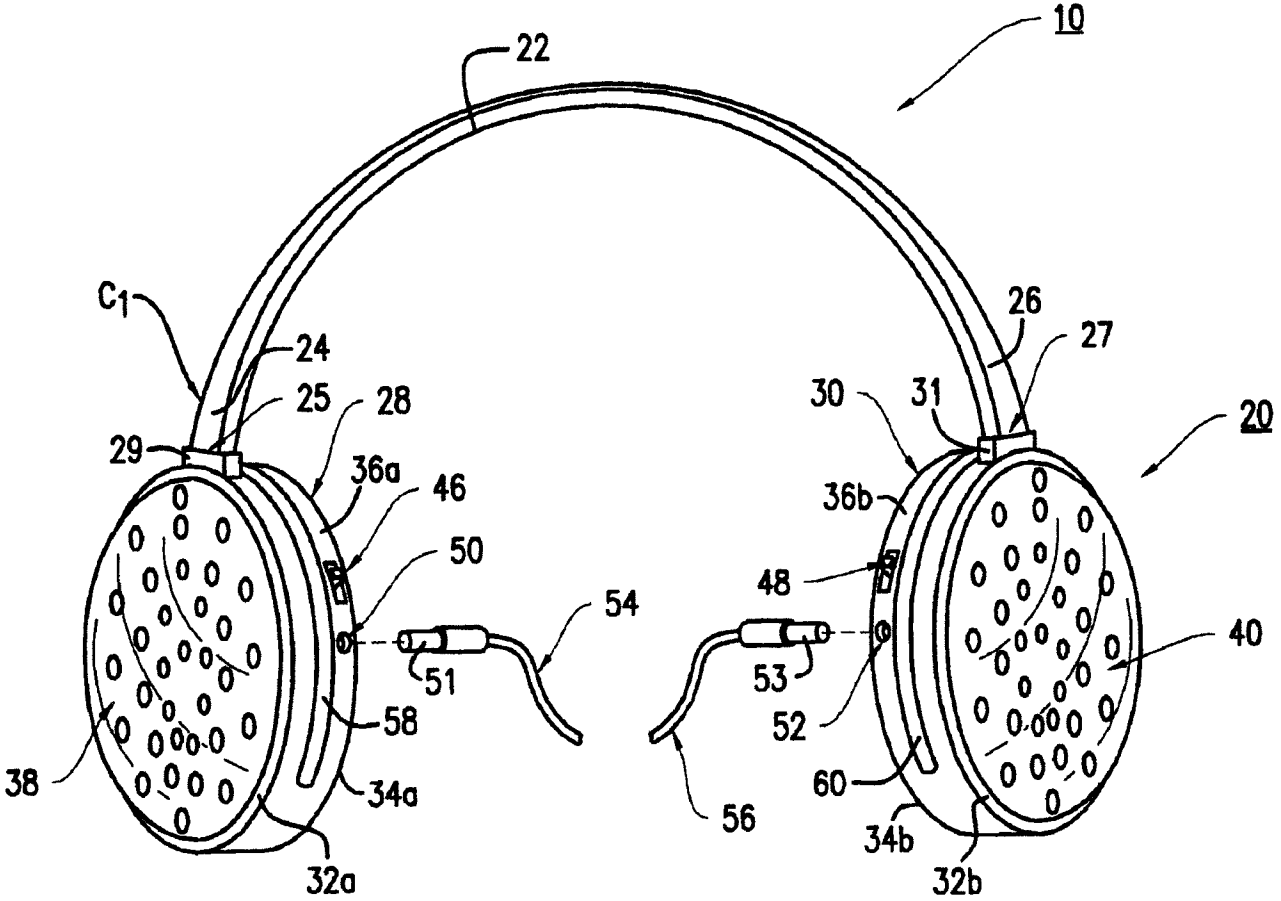
FIG. 1 is a perspective view of the combined headphone set of the first embodiment of the present invention showing the major component parts in an assembled configuration for use on a head of the user.
Figure 2:
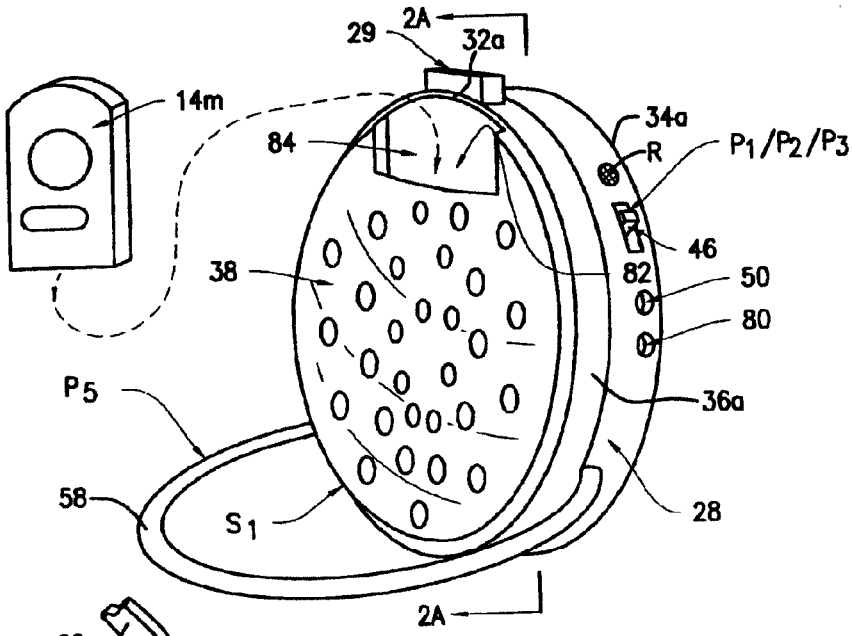
FIG. 2 is a front perspective view of the combined headphone set of the present invention showing a headphone speaker in a stand-alone speaker mode.
Figure 3:
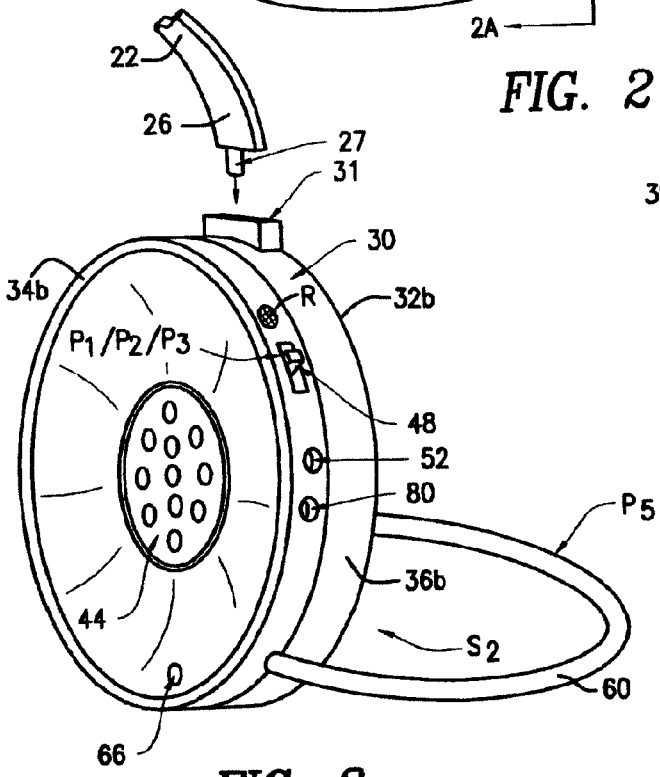
FIG. 3 is a rear perspective view of the combined headphone set of the present invention showing an interior ear speaker, a female receiving snap member connecting to a male insert member and the ring stand in an opened position.
Figure 4:
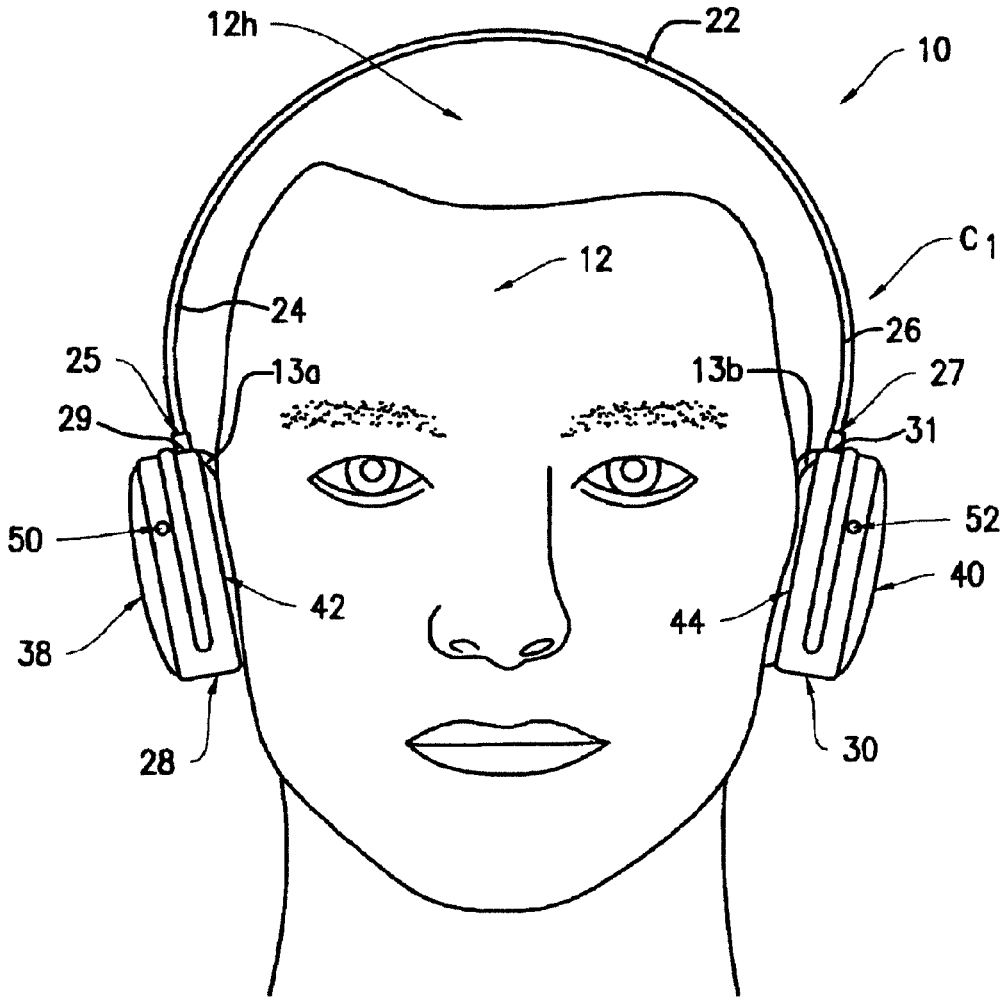
FIG. 4 is a front elevational view of the combined headphone set of the present invention showing the headphone set in the assembled configuration for use on the wearer's head.
Figure 5:
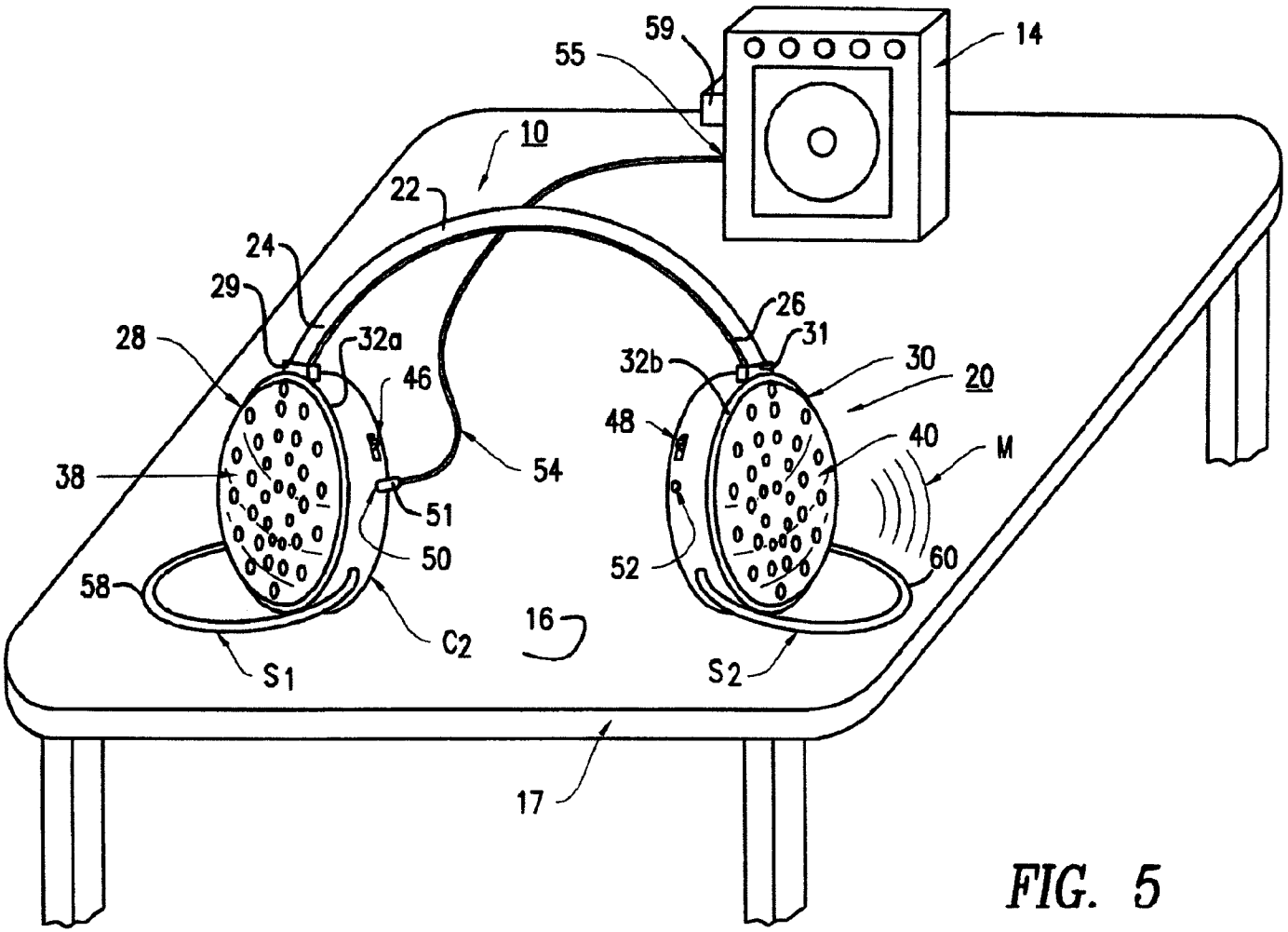
FIG. 5 is a front perspective view of the combined headphone set of the present invention showing the unattached configuration (not on a user's head) of the speaker headphones attached to a headband being used in the stand-alone speaker modes.
Figure 5A:
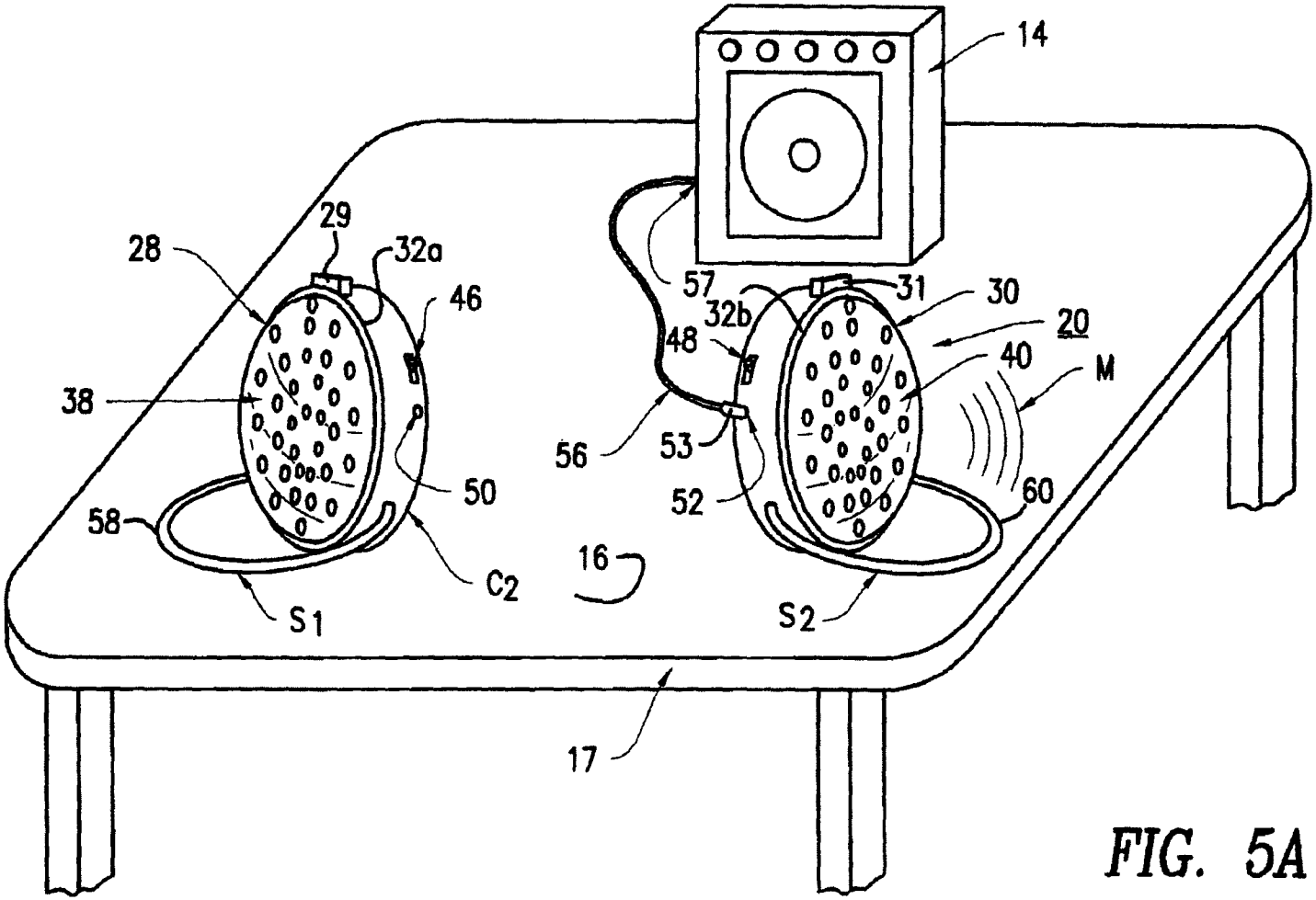
FIG. 5A is a front perspective view of the combined headphone set of the present invention showing the unattached configuration (not on a user's head) of each of the speaker headphones being used in the stand-alone speaker modes.

The combined headphone set 10 having a pair of speaker headphone assemblies 28 and 30, wherein each speaker headphone assembly includes an exterior speaker 38 and 40 and an interior ear speaker 42 and 44 and their component parts of the preferred embodiment of the present invention that are represented in detail by FIGS. 1, 2, 2A, 2B through 5 and 5A of the patent drawings. When the combined headphone set 10 is in an assembled configuration $C_1$ on the user's head 12*h*, the user 12 can listen to sound, music M and the like from an audio device 14 by listening to each of the interior ear speakers 42 and 44 for personal listening, or by listening to each of exterior speakers 38 and 40 for public listening, or to both speakers 42, 44 and 38, 40 simultaneously. The combined headphone set 10 also be used in an unattached configuration $C_2$ when not on the user's head 12*h*, as shown in FIGS. 2, 5 and 5A, such that each of the speaker headphone assemblies 28 and 30 on headphone set 10 have speaker modes $S_1$ and $S_2$ in order for one or more listeners to hear the exterior speakers 38 and 40, or the interior ear speakers 42 and 44, or both when on a flat surface 16 of table 17.

The combined headphone set 10, as shown in FIGS. 1 and 5, includes a headband 22 having a speaker headphone assembly 28 and 30 on opposing ends 24 and 26 of the headband 22. Each of the opposing ends 24 and 26 of headband 22 are permanently attached to a connection member 29 and 31 on each of the speaker headphone assemblies 28 and 30, respectively.

In an alternate design configuration, as shown in FIGS. 2, 3 and 5A, the combined headphone set 10 includes a headband 22 having a first end 24 and a second end 26. The first end 24 includes a first male insert snap member 25 and the second end 26 includes a second male insert snap member 27. The headphone set 10 also includes the pair of speaker headphone assemblies 28 and 30 being detachably connected to the first and second male insert members 25 and 27, respectively, as shown in FIGS. 1, 2 and 3 of the drawings. Each of the first and second male insert snap members 25 and 27 are detachably connected to first and second female receiving snap members 29 and 31 on the first and second speaker headphone assemblies 28 and 30, respectively.

Each of the speaker headphone assemblies 28 and 30 include an exterior side 32*a* and 32*b*, an interior side 34*a* and 34*b* and a perimeter wall 36*a* and 36*b*, respectively. Each of the exterior sides 32*a* and 32*b* of speaker headphones 28 and 30 includes exterior speakers 38 and 40, respectively. Each of the interior sides 34*a* and 34*b* of speaker headphones 28 and 30 include interior ear speakers 42 and 44, respectively.

The perimeter wall 36*a* and 36*b* on each of the speaker headphones 28 and 30 include three-way switches 46 and 48, respectively, as depicted in FIGS. 1 to 3 of the drawings. The three-way switches 46 and 48 are used for listening by a user 12 to sound, music M and the like from the exterior speakers 38 or 40 at a position $P_1$, or from the interior ear speakers 42 or 44 at a position $P_2$, or from both exterior speaker 38, 40 and both interior ear speakers 42 and 44, simultaneously at a position $P_3$, as shown in FIGS. 4 and 5 of the drawings. The perimeter wall 36*a* and 36*b* on each of the speaker headphones 28 and 30 also include input jack connections 50 and 52, respectively. Each of the input jack connections 50 and 52 are detachably connected by input jacks 51 and 53, respectively, from audio signal wires 54 and 56 being detachably connected to output jacks 55 and 57, respectively, on the audio device 14.

Alternatively, the headphone set 10 also provides for each of the speaker headphone assemblies 28 and 30 having at least one audio signal wire 54 or 56 being connected from an output jack 55 or 57 of an audio device 12 to an input jack 51 or 53 of either one or each of the speaker headphones 28 and 30. This may be in the form of various standard connectors.

Further, each of the speaker headphones 28 and 30 having an audio signal M can incorporate various wireless technologies such as 49 MHz, 900 MHz, 2.4 GHz, 5.8 GHz, Bluetooth, Wireless USB, 802.22b, or the like, having a wireless transmitter 59 (see FIG. 5) connected from the output jack 55 or 57 of the audio device 14 sending the audio signal M, to a receiver R (see FIG. 2) embedded on each of the speaker headphones 28 and 30, respectively.

Additionally, the perimeter wall 36*a* and 36*b* on each of the speaker headphones 28 and 30, include pivotally-connected ring stands 58 and 60, respectively, as shown in FIGS. 1, 2 and 3 of the drawings. Each of the pivotally-connected ring stands 58 and 60 are movable from a closed position $P_4$ on perimeter wall 36*a* or 36*b* to an open position $P_5$ being positioned on a surface 16 on table 17 for use in speaker modes $S_1$ and $S_2$, respectively, as shown in FIGS. 5 and 5A.

Figure 2A:
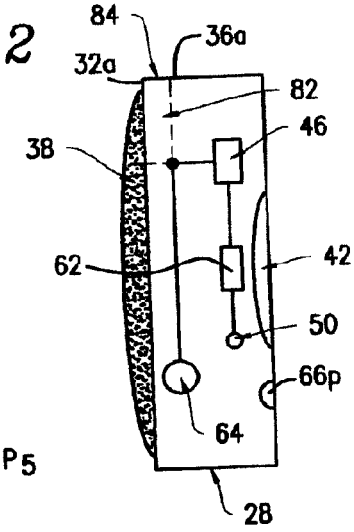
FIG. 2A is a cross-sectional view of the combined headphone set of the present invention taken along lines 2A-2A in the direction of the arrows showing an exterior speaker, a ring stand, an input jack connection, a three-way switch, an amplifier and a power source.

As shown in FIG. 2A, each of the exterior speakers 38 and 40 can be an "active speaker" by each including a built-in amplifier 62 and a power source 64, respectively, being electrically connected to each of the three-way switches 46 and 48 and input jack connections 50 and 52, respectively. Alternatively, each of the exterior speakers 38 and 40 can be a "passive speaker" which uses the internal amplifier (not shown) of the portable audio device 14 (see FIG. 5). Additionally, each of the speaker headphones 28 and 30 can have a rectangular shape, a square shape, a triangular shape, an oval shape, an octagon shape, or a cylindrical shape.

Each of speaker headphones 28 and 30 also include a sensor 66 being a beam of light (such as an infrared), or an audio signal, or a pressure sensitive sensor 66*p* to detect if the speaker headphones 28 and 30 are on the user's head 12*h*, as depicted in FIG. 3. When not placed on the user's head 12*h*, the speaker headphones 28 and 30 would automatically switch from private (headphone) personal use to audible/public speaker use.

In a further alternate design, combined headphone set 10 has wireless speaker headphone assemblies 28 and 30 having a power source 64 therein; as depicted in FIGS. 1 and 2A of the drawings.

Figure 2B:
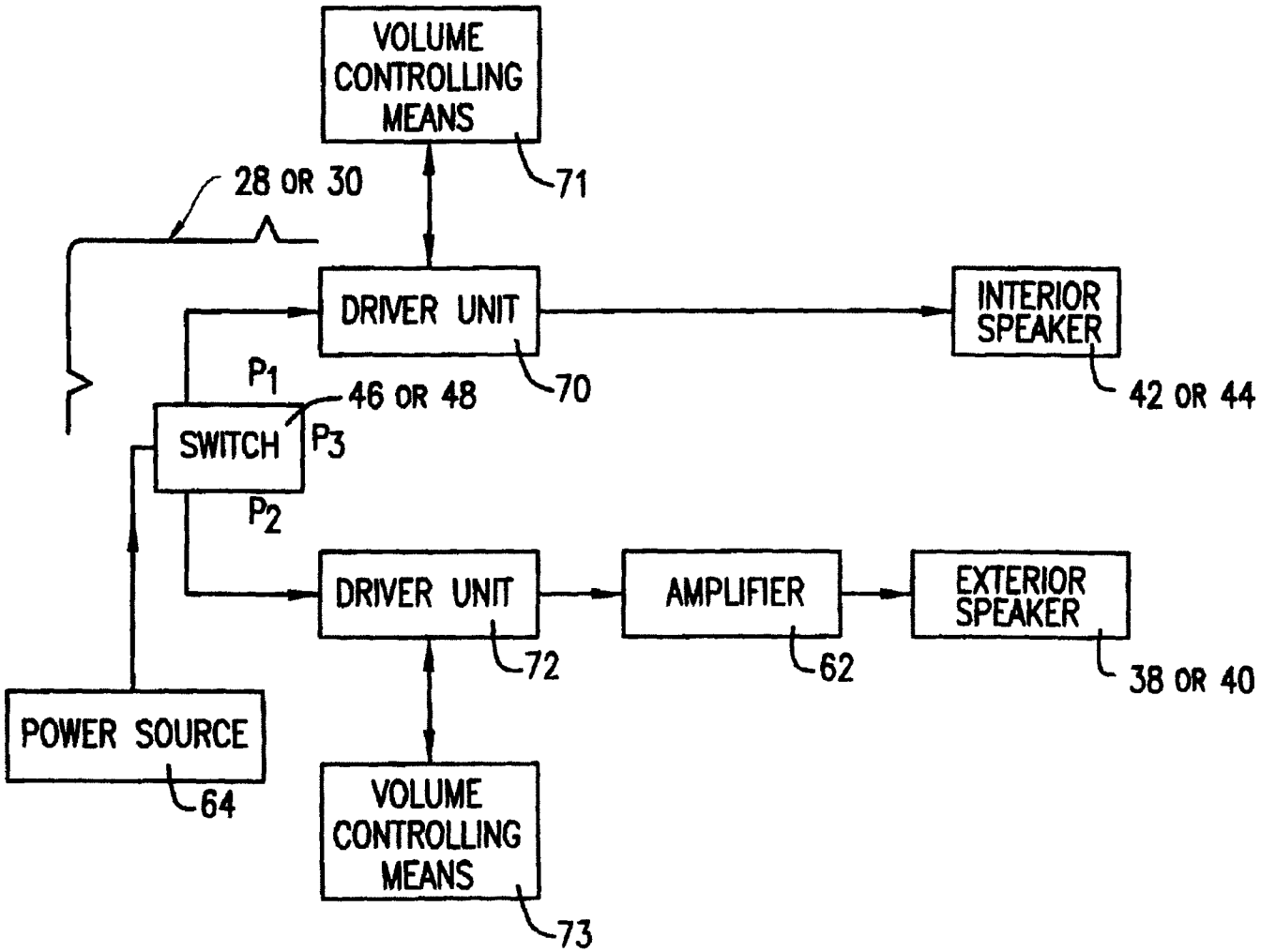
FIG. 2B is a block diagram of the combined headphone set of the present invention showing a pair of stereo headphone driver units within a speaker headphone.
Figure 2C:
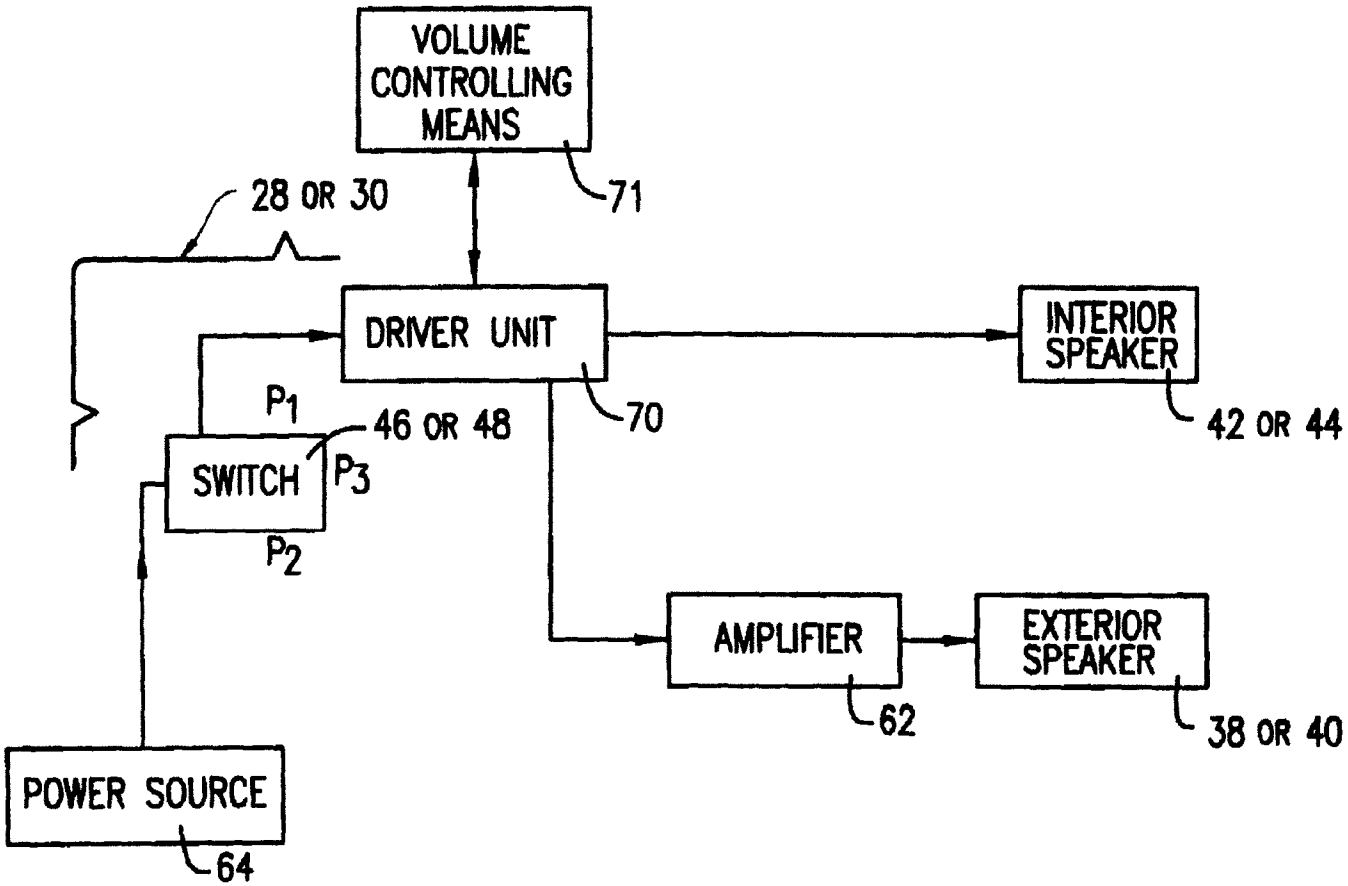
FIG. 2C is a block diagram of the combined headphone set of the present invention showing a single stereo headphone driver unit within the speaker headphone.

The headphone set 10 has the ability for each left and right speaker headphone assemblies 28 and 30 to include a stereo headphone driver unit 70 and 72 having an amplifier 62 therein in order to significantly increase the volume/audio level M when not positioned on the user's head 12*h*, as shown in FIG. 2B. Alternatively, the left and right speaker headphone assemblies 28 and 30 can include a single stereo headphone driver unit 70 having an amplifier 62 for connecting to both speakers 38 and 40 and 42 and 44, respectively, as depicted in FIG. 2C. This may be accomplished either by using a pressure sensitive sensor 66*p* or by using a form of either a beam of light, such as infrared or other light or an audio frequency that can detect the proximity of the stereo headphone driver unit 70 and 72 to the user's head 12*h*. This provides a safety measure that will not allow the audio/volume level M to increase to a point of potentially causing hearing damage from excessive loud audio signals M.

Figure 2D:
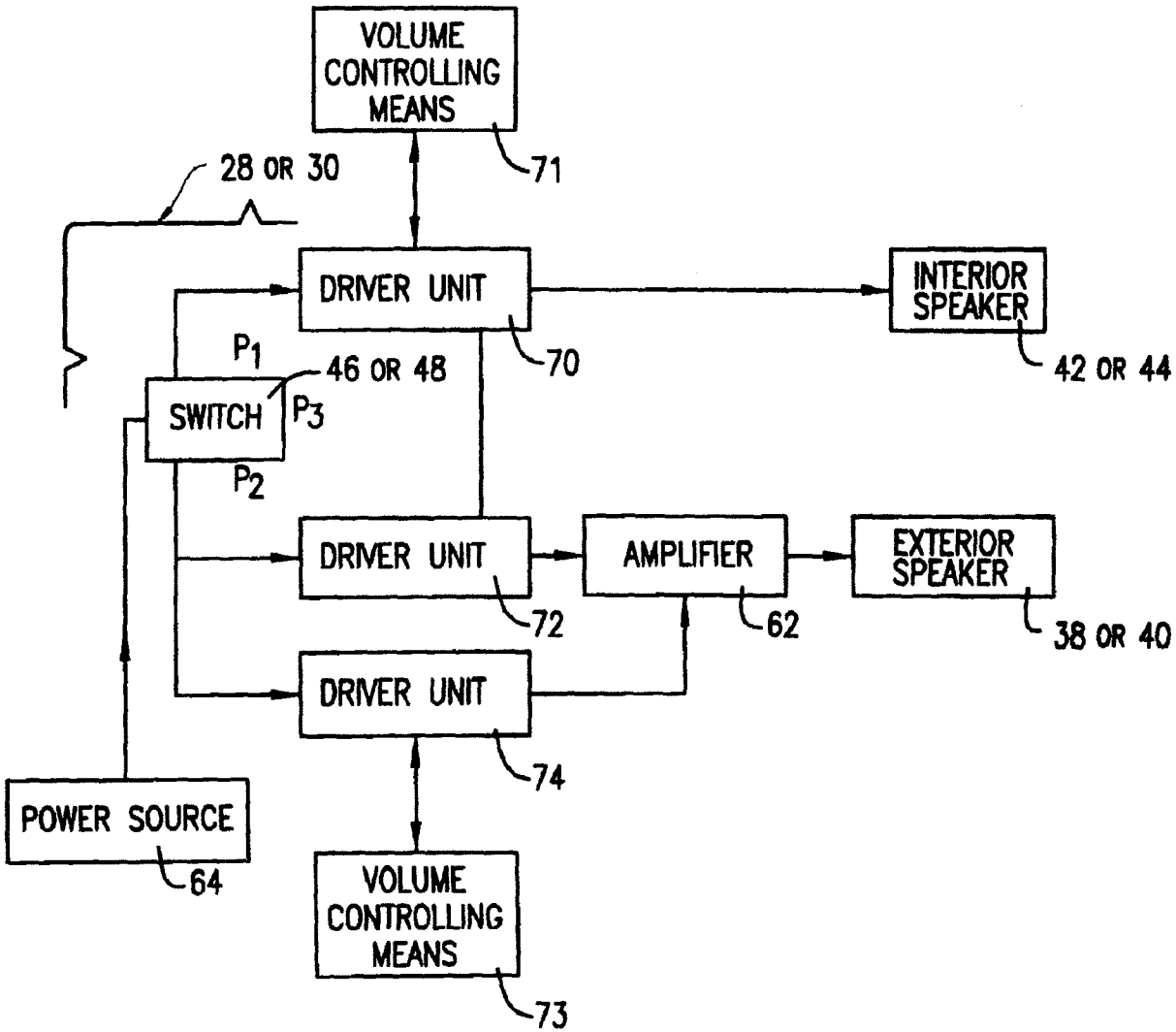
FIG. 2D is a block diagram of the combined headphone set of the present invention showing three stereo headphone driver units with the speaker headphone.
Figure 2E:
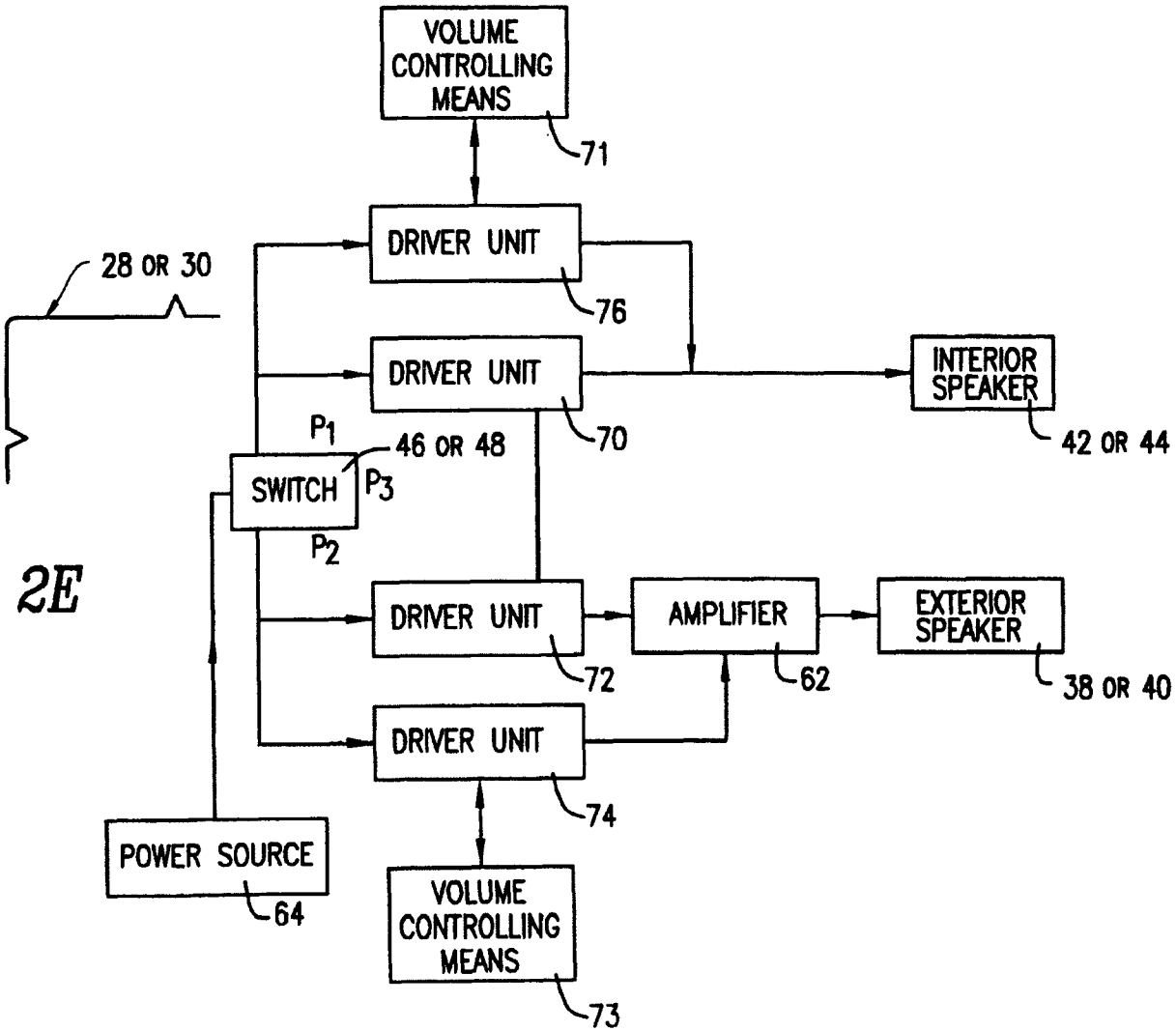
FIG. 2E is a block diagram of the combined headphone set of the present invention showing four stereo headphone driver units with the speaker headphone.

In another alternate design, as shown in FIG. 2D, switch 46 or 48 includes a third driver unit 74 attached to amplifier 62 in order to allow exterior speaker 38 or 40 to become louder. This alternate design includes volume controlling means 73 for presetting the volume to each of the exterior speakers 38 and 40. FIG. 2E depicts multiple speaker driver units 70, 76, 72 and 74 for use with interior and exterior speakers, respectively.

It is understood when the interior speakers 42 and 44 are in operational use on the user's head 12, as shown in FIG. 4, driver unit 70 includes volume controlling means 71 for presetting a maximum volume to each of the interior speakers 42 and 44, respectively (See FIGS. 2B, 2C, 2D and 2E).

Figure 2F:
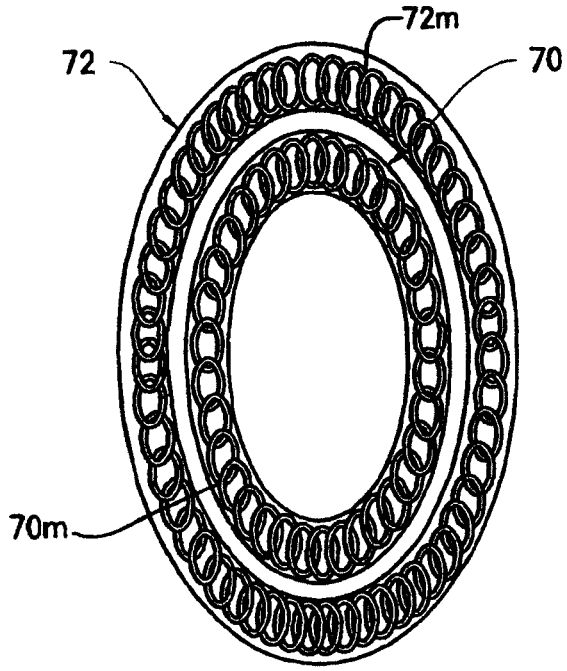
FIG. 2F is a perspective view of the combined headphone set of the present invention showing a pair of magnetic speaker coils being wrapped within each other as part of the exterior and interior speaker driver units.
Figure 2G:
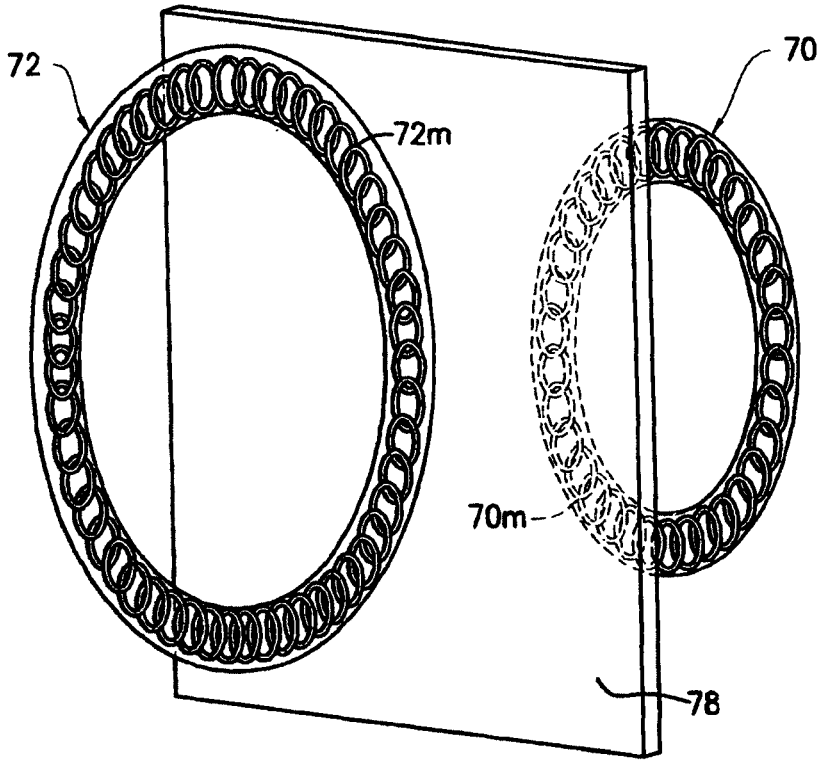
FIG. 2G is a perspective view of the combined headphone set of the present invention showing each of the magnetic speaker coils being separated by an insulator sheet.

Each of the speaker driver units 70, 72 and 74 include a magnetic speaker coil 70*m*, 72*m* and 74*m* as part of the above speaker driver units 70, 72 and 74, respectively, as shown in FIGS. 2F and 2G. The magnetic speaker coils 70*m* and 72*m* can be configured where the magnetic coils are wrapped within each other or where each of the magnetic coils are separated by an insulator sheet 78, as shown in FIGS. 2F and 2G.

In each of the speaker headphone assemblies 28 and 30 there could also be a monaural system (not shown), wherein either the left channel or right channel audio signal is being sent into both left and right speaker headphones 28 and 30, respectively.

Also, one of the speaker headphone assemblies 28 or 30 of headphone set 10, as shown in FIGS. 2 and 3, includes a signal pass-through port 80 enabling a second user to plug in their own headphone set of any kind in order to listen to the same audio source M as the original user.

Additionally, one of the speaker headphone assemblies 28 and 30 of headphone set 10, as depicted in FIG. 2, includes a pocket 82 having a receiving slot opening 84 for receiving a mini audio device 14*m* therein or a device that has memory to store digitized audio files. The audio device 14*m* may be an MP3 player, an iPOD or other audio device. Receiving slot opening 84 is positioned on an upper section 38*u* of exterior speaker 38.

Second Embodiment 100

The combined headphone set 100 having a detachable speaker assembly 130 and its component parts of the second embodiment of the present invention are represented in detail by FIGS. 6 through 10 of the patent drawing. The combined headphone set 100 is an external audio signal passthrough system which enables personal listening using ear-bud speaker headphones 110, or clip-on headphone speakers or standard headphone speakers. The combined headphone set 100 having a detachable speaker assembly 130 is used in an assembled configuration $C_4$ joining a portable ear-bud headphone 110 with the detachable speaker assembly 130, such that the audio signal M passes through from the ear-bud headphone 110 to the detachable speaker assembly 130, or when the portable ear-bud headphone 110 is used in an unassembled configuration $C_5$ by a user for listening to headphone 110 by itself.

Figure 6:
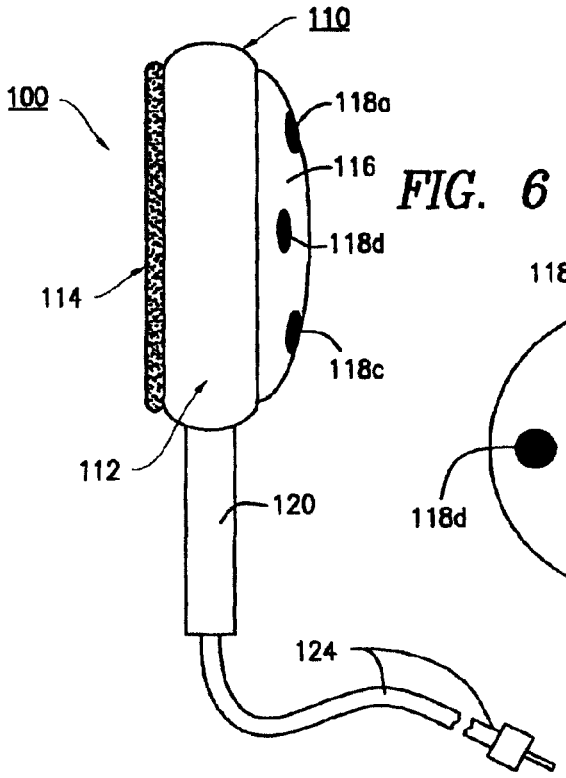
FIG. 6 is a side elevational view of the portable ear-bud headphone of the second embodiment of the present invention showing an interior ear-bud speaker having exterior electrical contact points, a stem and an audio signal wire.
Figure 7:
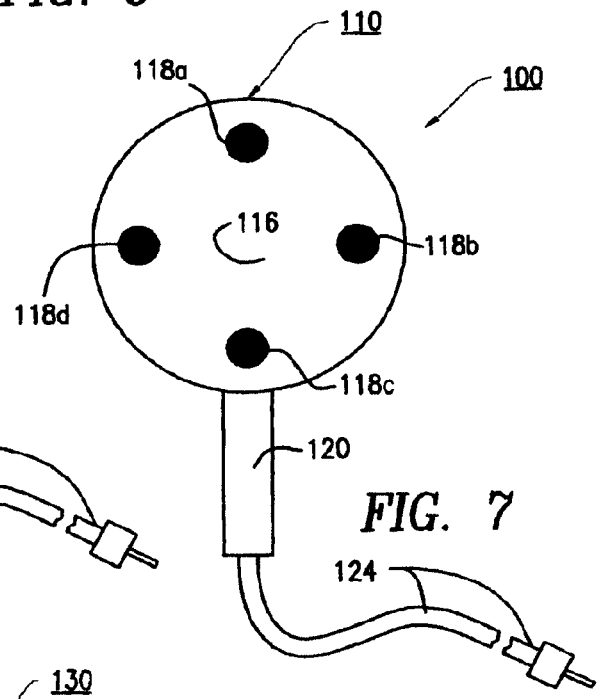
FIG. 7 is a rear plan view of the portable ear-bud headphone of the present invention showing the exterior electrical contact points, the stem and the audio signal wire.
Figure 9:
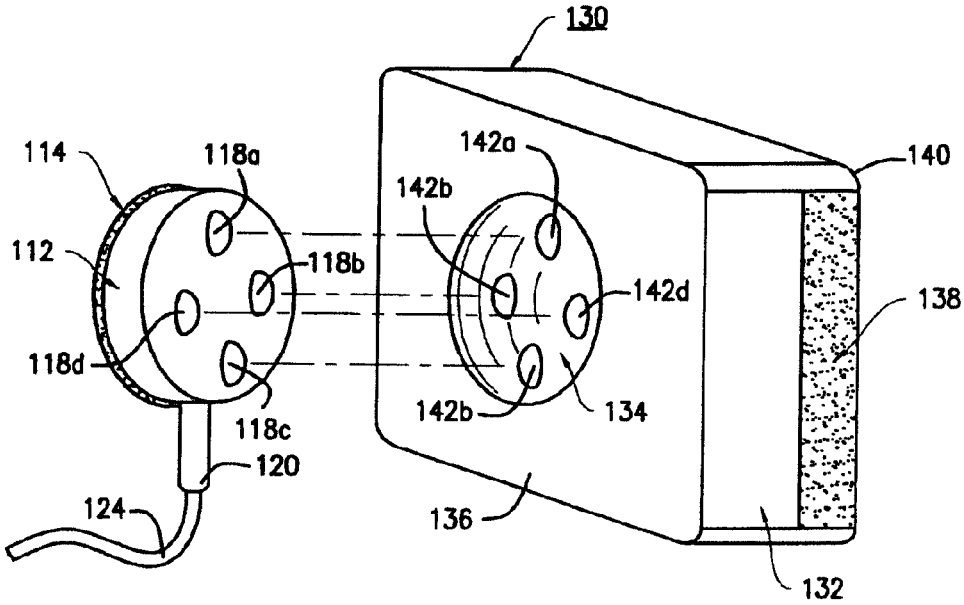
FIG. 9 is an exploded perspective view of the portable ear-bud headphone of the present invention showing the exterior electrical contact points of the ear-bud headphone being matched to the interior electrical contact points of the detachable headphone speaker assembly having the exterior speaker thereon.

The portable ear-bud headphone 110, as shown in FIGS. 6, 7 and 9, includes an ear-bud housing 112 having an interior ear speaker 114, and a concave section 116 with a plurality of spaced-apart exterior electrical contact points 118*a*, 118*b*, 118*c* and 118*d* thereon. Ear-bud housing 112 also includes a hollow stem member 120 integrally connected to a perimeter edging 122. Stein member 120 has an audio signal wire 124 electrically connected to the interior ear speaker 114. The interior ear speaker 114 is on the opposing side of the exterior electrical contact points 118*a* to 118*d*.

Figure 8:
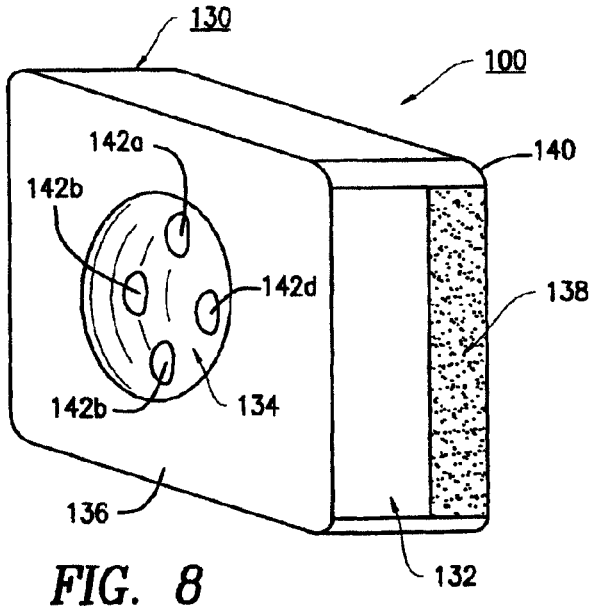
FIG. 8 is a side perspective view of the portable ear-bud headphone of the present invention showing a detachable headphone speaker assembly having an exterior speaker and an interior recessed compartment with interior electrical contact points.
Figure 10:
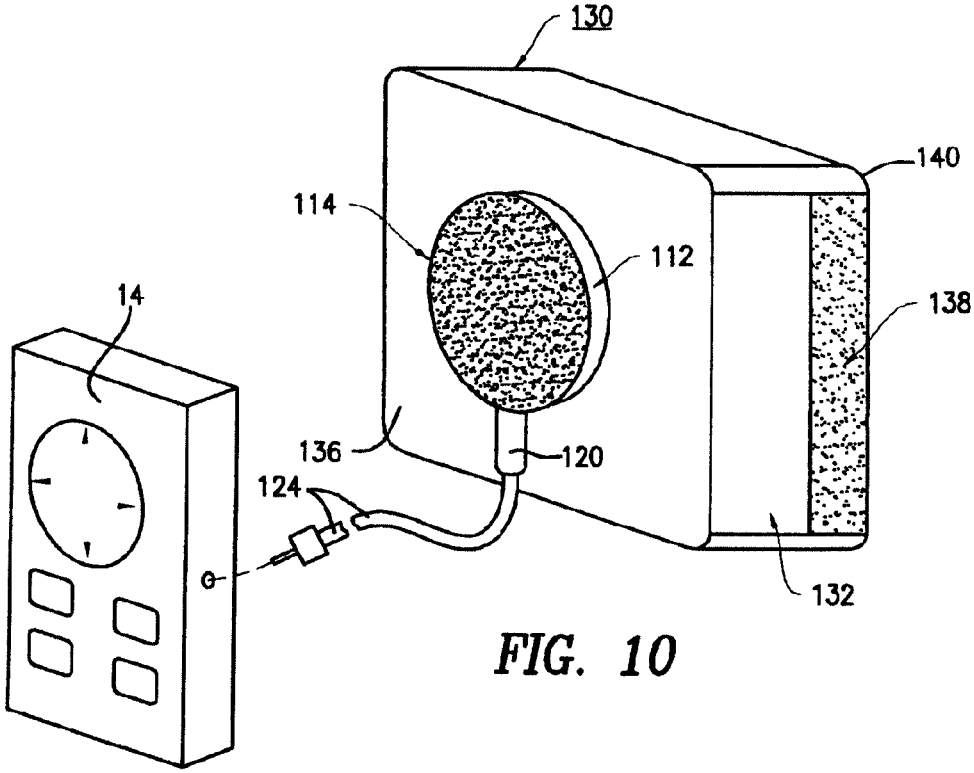
FIG. 10 is a perspective view of the portable ear-bud headphone of the present invention showing a combined headphone set in an assembled configuration for attaching to an audio device.

The detachable headphone speaker assembly 130, as shown in FIGS. 8, 9 and 10, includes a speaker housing 132, having an interior recessed compartment 134 on one side 136 and an exterior speaker 138 on the opposing side 140. The interior recessed compartment 134 includes a plurality of spaced-apart interior electrical contact points 142*a*, 142*b*, 142*c* and 142*d*. The exterior electrical contact points 118*a* to 118*d* of the ear-bud headphone 110 is inserted and matched to the interior electrical contact points 142*a* to 142*d* within the interior recessed compartment 134 of the detachable headphone speaker assembly 130 in order for the exterior speaker 138 to send out sound, music M from the audio device 12 when the exterior and interior electrical contact points 118*a* and 142*a*, 118*b* and 142*b*, 118*c* and 142*c*, and 118*d* and 142*d* are matched together, as shown in FIGS. 9 and 10 of the drawings. It is understood that the interior recessed compartment 134 can be configured on the top, back, sides or bottom of the speaker housing.

Third Embodiment 200

Figure 11:
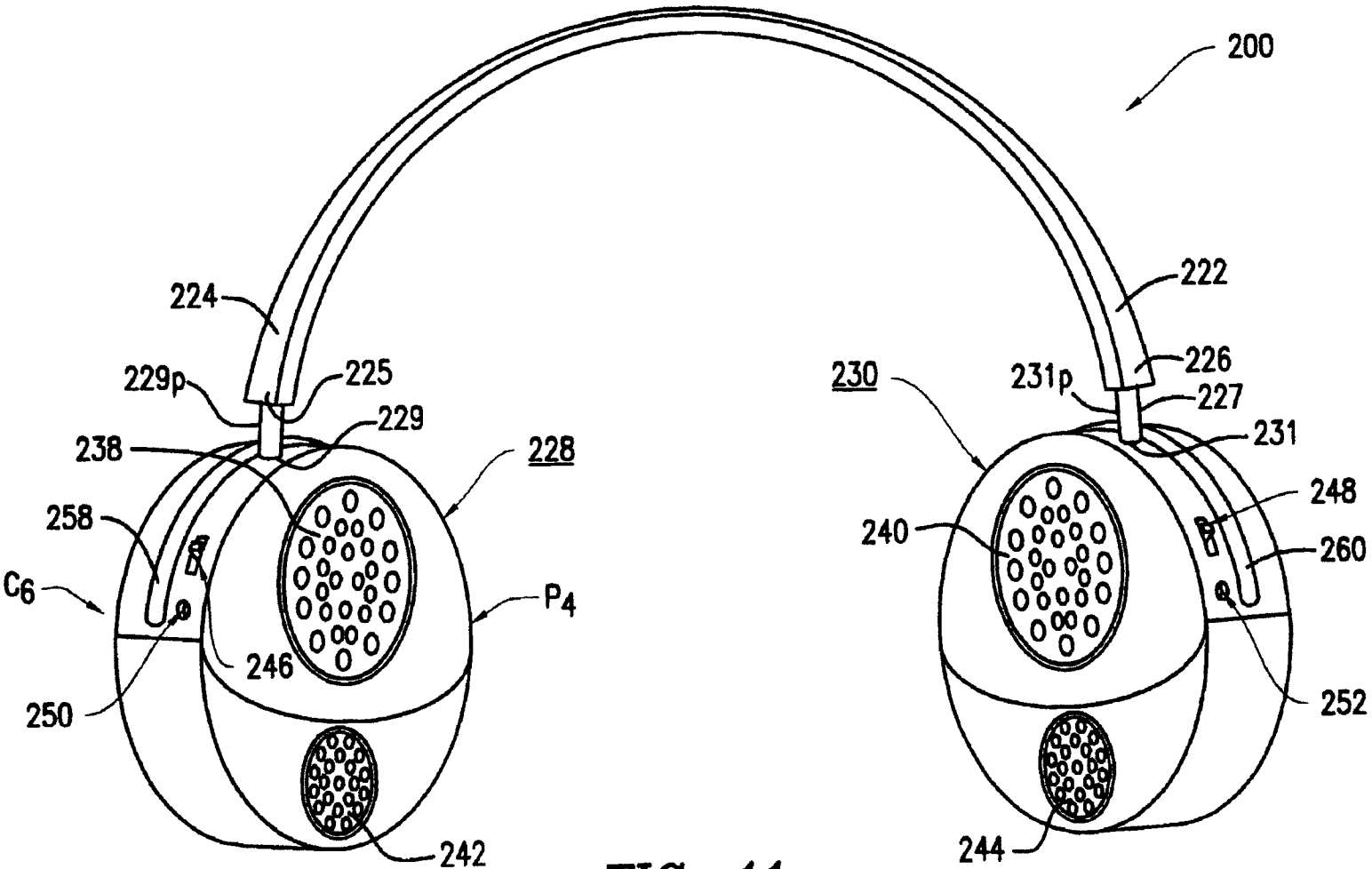
FIG. 11 is a perspective view of the combined headphone set of the third embodiment of the present invention showing the major component parts in an assembled configuration for use on a head of the user.
Figure 13:
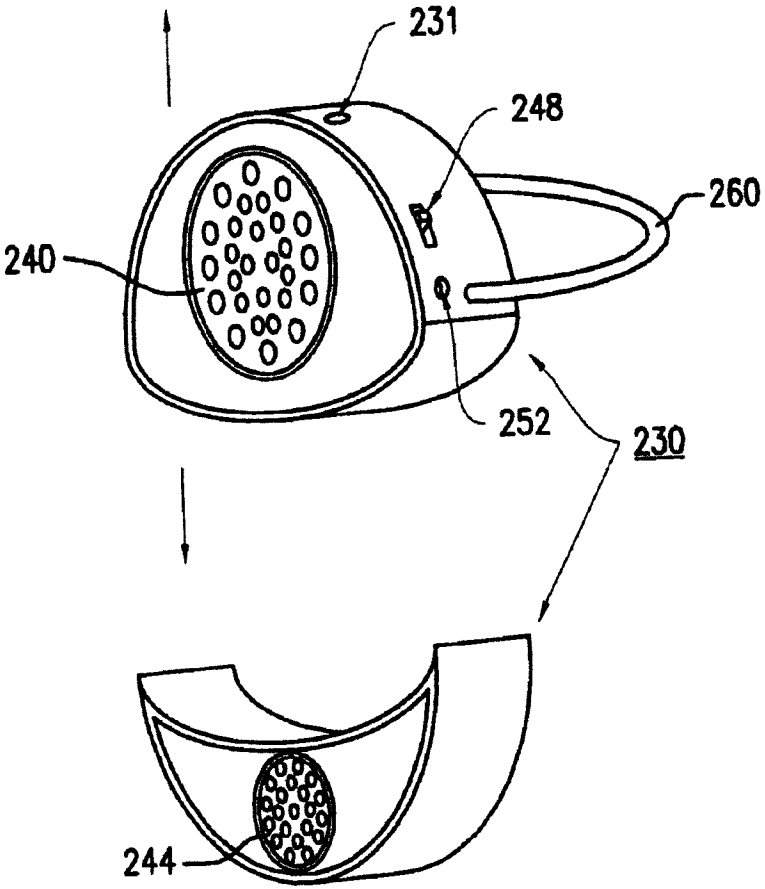
FIG. 13 is an exploded perspective view of the combined headphone set of the present invention showing the exterior speaker being detachably removed from one of the speaker headphones.
Figure 14:
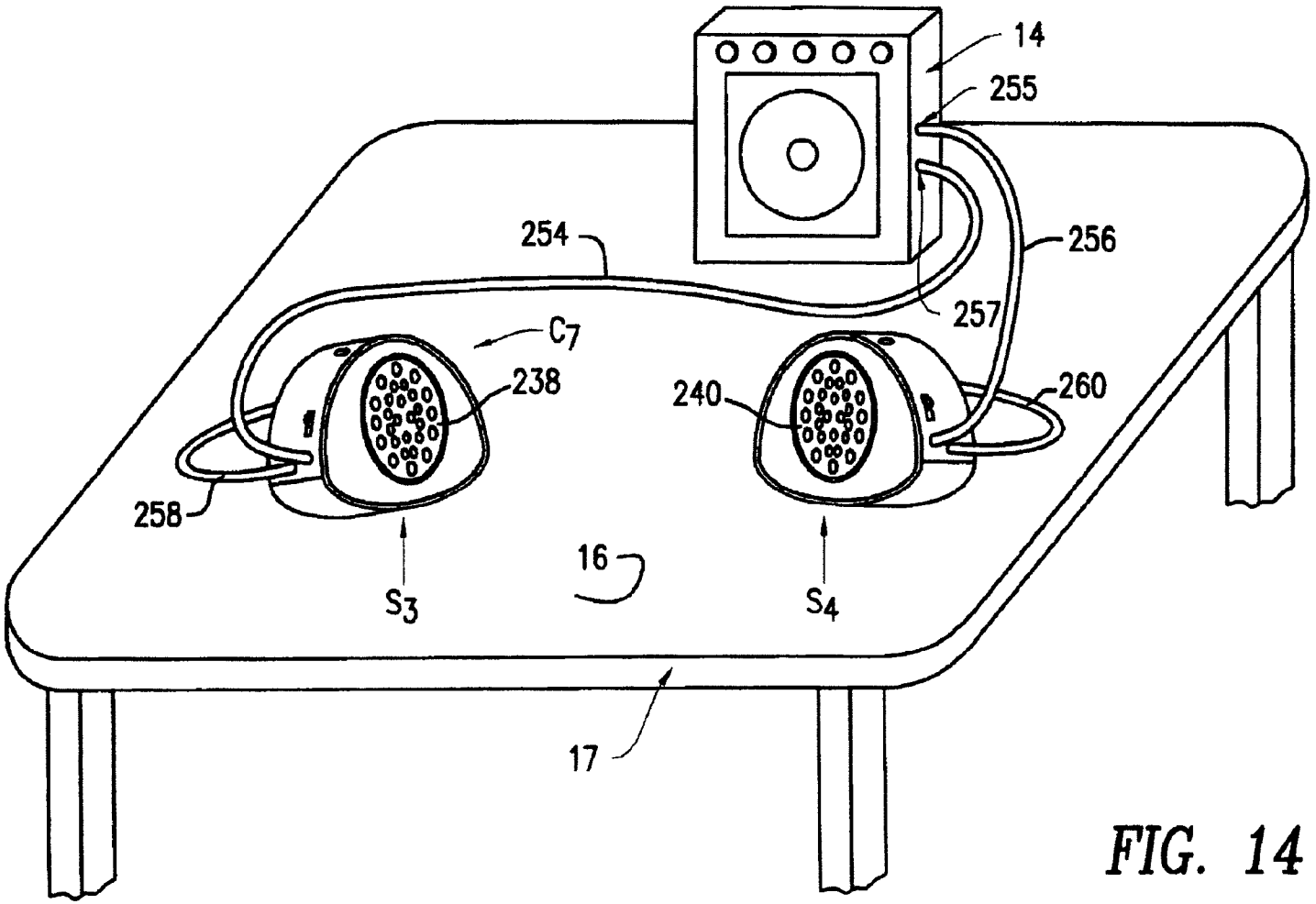
FIG. 14 is a front perspective view of the combined headphone set of the present invention showing the unattached configuration (not on a user's head) of each of the detachable exterior speakers being used in the stand-alone speaker modes.

The combined headphone set 200 having a pair of speaker headphone assemblies 228 and 230, wherein each speaker headphone assembly includes exterior speakers 38 and 40 and interior ear speakers 42 and 44 and their component parts of the third embodiment of the present invention that are represented in detail by FIGS. 11, 12, 13 and 14 of the patent drawings. As shown in FIG. 11, each of the exterior speakers and interior speakers 238 and 242, and 240 and 244 are in a front-to-front, side-by-side configuration within speaker headphone assemblies 228 and 230, respectively. When the combined headphone set 200 is in an assembled configuration $C_6$ on the user's head 12*h*, the user 12 can listen to sound, music M and the like from an audio device 14 by listening to each of the interior ear speakers 242 and 244 for personal listening. The combined headphone set 200 can also be used in an unattached configuration $C_7$ when not on the user's head 12*h*, as shown in FIGS. 13 and 14 such that each of the speaker headphone assemblies 228 and 230 on headphone set 200 have speaker modes $S_3$ and $S_4$ in order for one or more listeners to hear the exterior speakers 238 and 240 when on a flat surface 16 of Table 17.

Figure 12:
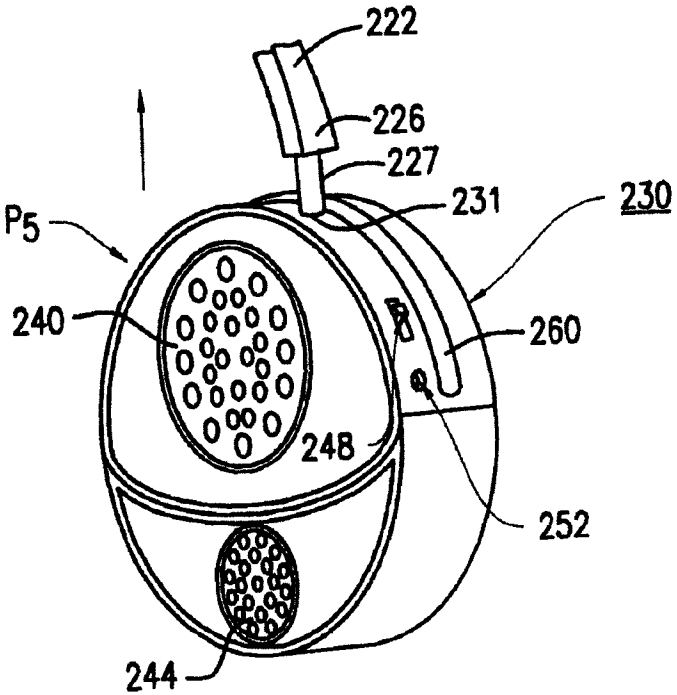
FIG. 12 is a perspective view of the combined headphone set of the present invention showing a headphone speaker having an exterior speaker and interior speaker in a side-by-side configuration.

The combined headphone set 200, as shown in FIGS. 11 and 12 includes a headband 222 having a speaker headphone assembly 228 and 230 on opposing ends 224 and 226 of the headband 222. Each of the opposing ends 224 and 226 of headband 222 are permanently attached to a connection member 229 and 231 on each of the speaker headphone assemblies 228 and 230, respectively.

As shown in FIG. 11, each of said speaker headphones 228 and 230 are movable from a personal listening position $P_4$ to a public listening position $P_5$. Further, each of said speaker headphones 228 and 230 are swivable about a pivot point 229*p* and 231*p* on opposing ends 224 and 226, respectively, of headband 222.

As shown in FIGS. 12 and 13, each of the speaker headphone assemblies 228 and 230 includes a detachable exterior speaker 238 and 240 that slides and pops away from each of the speaker headphone assemblies 228 and 230 respectively. This allows for the detachable exterior speakers 238 and 240 to be in the public listening mode when in the unattached configuration $C_7$.

It is understood that in the Third Embodiment 200, all of the alternate design considerations are applicable as detailed in the First Embodiment 10.

Operation of the Present Invention

As shown in FIGS. 1, 4 and 5, the combined headphone set 10 having a pair of speaker headphone assemblies 28 and 30 operate in the following manner: The user 14 initially starts with the headphone set 10 in its assembled configuration $C_1$ such that the headband 22 and each of the speaker headphone assemblies 28 and 30 are connected to opposing ends 24 and 26 of the headband 22. The headphone set 10 is now operational and the user 12 places the interior ear speakers 42 and 44 on each of the user's ears 13*a* and 13*b*, as depicted in FIG. 4 of the drawings. The user 12 then uses the three-way switches 46 and 48 on speaker headphone assemblies 28 and 30, respectively, and positions the switch, ie. to position $P_2$ in order to hear from both interior ear speakers 42 and 44, respectively, as shown in FIGS. 1 and 4. The user 14 then inserts input jacks 51 and 53 of audio signal wires 54 and 56 into input jack connections 50 and 52 on each speaker headphone assemblies 28 and 30, respectively, in order for the listener 12 to hear music M from the audio device 14.

If the user 12 decides to listen to the speaker headphone assemblies 28 and 30 for use in speaker modes $S_1$ and $S_2$, respectively, on a flat surface 16 of table 17, as shown in FIG. 5, the user 12 simply takes the headphone set 10 off the user's head 12*h*. The user 12 now pivotally positions and moves each of the ring stands 58 and 60 on perimeter wall 36*a* and 36*b* from a closed position $P_4$ to an open position $P_5$ on surface 16 of table 17 for use in speaker modes $S_1$ and $S_2$, respectively, as shown in FIG. 5. The next step has the user 12 connecting again the audio signal wires 54 and 56 to output jacks 55 and 57 on audio device 14 and connecting again the input jacks 51 and 53 of audio signal wires 54 and 56 to the input jack connections 50 and 52 on each speaker headphone assemblies 28 and 30, respectively. Now the user 12 positions the three-way switches 46 and 48 to position $P_3$, such that the listener 12 has both the exterior speakers 38 and 40 and the interior ear speakers 42 and 44 being simultaneously heard by the listener, as depicted in FIG. 5.

In an alternate design configuration as shown in FIGS. 1, 4 and 5A, the combined headphone set 10 having a pair of speaker headphone assemblies 28 and 30 operate in the following manner: The user 12 initially starts with the headphone set 10 in its assembled configuration $C_1$ such that the headband 22 and each of the speaker headphone assemblies 28 and 30 are connected to opposing ends 24 and 26 of the headband 22. The headphone set 10 is now operational and the user 12 places the interior ear speakers 42 and 44 on each of the user's ears 13*a* and 13*b*, as depicted in FIG. 4 of the drawings. The user 12 then uses the three-way switches 46 and 48 on speaker headphones 28 and 30, respectively, and positions the switch, ie. to position $P_2$ in order to hear from both interior ear speakers 42 and 44, respectively, as shown in FIGS. 1 and 4. The user 12 then inserts input jacks 51 and 53 of audio signal wires 54 and 56 into input jack connections 50 and 52 on each speaker headphone assemblies 28 and 30, respectively, in order for the listener 12 on the user's head 12*h* to hear music M from the audio device 14.

If the user 12 decides to listen to the speaker headphone assemblies 28 and 30 for use in speaker modes $S_1$ and $S_2$, respectively, on a flat surface 16 of table 17, as shown in FIG. 5A, the user 12 simply takes the headphone set 10 off the user's head 12*h*. The user 12 now pivotally positions and moves each of the ring stands 58 and 60 on perimeter wall 36*a* and 36*b* from a closed position $P_4$ to an open position $P_5$ on surface 16 of table 17 for use in speaker modes $S_1$ and $S_2$, respectively, as shown in FIG. 5A. The next step has the user 12 connecting again the audio signal wires 54 and 56 to output jacks 55 and 57 on audio device 14 and connecting again the input jacks 51 and 53 of audio signal wires 54 and 56 to the input jack connections 50 and 52 on each speaker headphone assemblies 28 and 30, respectively. Now the user 12 positions the three-way switches 46 and 48 to position $P_3$, such that the listener 12 has both the exterior speakers 38 and 40 and the interior ear speakers 42 and 44 being simultaneously heard by the listener, as depicted in FIG. 5A.

In an alternate embodiment 100, as shown in FIGS. 9 and 10, the combined headphone set 100 having a detachable speaker assembly 130 operates in the following manner: The user 14 normally operates the portable ear-bud headphone 110 such that the interior ear speaker 114 is attached and inserted into one of the user's users 15*a* or 15*b*. If the user 14 now wants to operate the combined headphone set 10 having the detachable speaker assembly 130, the user now attaches each member 110 and 130 with each other. The user then inserts the exterior electrical contact points 118*a* to 118*d* of the ear-bud headphone housing 112 into the interior recessed compartment 134, such that the exterior and interior electrical contact points 118*a* and 142*a*, 118*b* and 142*b*, 118*c* and 142*c*, and 118*d* and 142*d* are adjacent with each other and are matched together in order for music M to be sent out from exterior speaker 138 from audio device 12.

Advantages of the Present Invention

Accordingly, an advantage of the present invention is that it provides for a combined headphone set that has speaker headphones, such that each speaker headphone includes an interior ear speaker for personal listening and an exterior speaker for personal listening and an exterior speaker for public listening wherein each speaker is in a back-to-back configuration.

Another advantage of the present invention is that it provides for a combined headphone set that has a pair of speaker headphones that separate from the headband on the headphone set having detachable connection means on each of the speaker headphones.

Another advantage of the present invention is that it provides for each of the speaker headphones having a three-way switch for listening to the interior speaker or to the exterior speaker or to the interior and exterior speakers simultaneously from each of the speaker headphones.

Another advantage of the present invention is that it provides for each of the speaker headphones having an audio signal wire being connected from an output jack of an audio device to an input jack of each of the speaker headphones.

Another advantage of the present invention is that it provides for a combined headphone set that requires a minimal amount of storage space on a desk, in a drawer, or on a shelf.

A further advantage of the present invention is that it provides for a combined headphone set and a portable speaker assembly that can be mass-produced in an automated and economical manner and is readily affordable by the consumer.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A combined headphone set including a detachable speaker assembly, comprising:

a) a headphone set including a headband having a speaker headphone on opposing ends of said headband;

b) said headband having detachable connector members on said opposing ends for detachably connecting to each of said speaker headphones thereto;

c) each of said speaker headphones including an exterior side and an interior side; said exterior side of said speaker headphone including an exterior speaker and said interior side including an interior speaker for listening by each of the user's ears;

d) each of said speaker headphones having a pivotally-connected ring stand attached thereto, each of said ring stands are movable from a closed position to an open position being positioned on a surface as stand-alone speakers;

e) each of said ring stands being positioned on a perimeter edging of each of said speaker headphones, respectively, when said ring stand is in said closed position;

f) said perimeter edging of said speaker headphone including a three-way switch for listening to said interior speaker or to said exterior speaker or to said interior and exterior speakers simultaneously from each of said speaker headphones; and g) each of said speaker headphones including an audio signal wire for producing an audio signal being connected from an output jack of an audio device to an input jack of each of said speaker headphones.

2. A combined headphone set in accordance with claim 1, wherein said detachable connector members on said opposing ends of said headband include first and second male insert snap members, respectively.

3. A combined headphone set in accordance with claim 1, wherein each of said speaker headphones include connector means for detachable connecting to said detachable connector members.

4. A combined headphone set in accordance with claim 3, wherein said connector means include first and second female receiving snap members for receiving said first and second male insert snap members therein in order to attach said headband to each of said speaker headphones.

5. A combined headphone set including a detachable speaker assembly, comprising:

a) a headphone set including an ear-bud headphone housing having an interior ear-bud speaker on one side and an exterior convex member having a plurality of spaced-apart exterior electrical contact points thereon being positioned on the other side;

b) said ear-bud headphone housing including a stem member for receiving an audio signal wire therethrough for electrically connecting to said interior ear-bud speaker; said audio signal wire detachably connected to an audio device;

c) a detachable speaker assembly including a speaker housing having an exterior speaker on one side and an interior side having an interior recessed compartment;

d) said interior recessed compartment including a plurality of spaced-apart interior electrical contact points thereon; and e) said exterior electrical contact points of said ear-bud headphone housing inserted and matched with said interior electrical contact points within said interior recessed compartment of said speaker housing in order for said exterior speaker to send out sound/music from said audio device.

6. A combined headphone set in accordance with claim 5, wherein each of said exterior electrical contact points are made of copper.

7. A combined headphone set in accordance with claim 5, wherein each of said interior electrical contact points are made of copper.

8. A combined headphone set in accordance with claim 5, wherein said combined headphone set is used as a stand-alone speaker.

9. A combined headphone set in accordance with claim 5, wherein said interior recessed compartment is located on a top, a back, a side or a bottom of said speaker housing.

10. A combined headphone set in accordance with claim 5, wherein said headphone set uses an external audio signal passthrough system which enables personal listening using said interior ear-bud speaker or an interior clip-on speaker or a standard interior speaker.

11. A combined headphone set including a speaker assembly, comprising:

a) a headphone set including a headband having a speaker headphone on opposing ends of said headband;

b) each of said speaker headphones including an exterior speaker for public listening and an interior speaker for personal listening by the user;

c) each of said exterior speakers and said interior speakers being configured in side-by-side configuration within each of said speaker headphones;

d) one of said speaker headphones including switching means for listening to said interior speaker or to said exterior speaker from each of speaker headphones;

e) said speaker headphones including an audio signal wire being connected from an output jack of an audio device to said speaker headphones; and f) wherein each of said exterior speakers are detachably connected to each of said speaker headphones.

12. A combined headphone set in accordance with claim 11, wherein each of said exterior speakers detachably slide away from each of said speaker headphones.

13. A combined headphone set in accordance with claim 11, wherein each of said exterior speakers detachably pops away from each of said speaker headphones.

14. A headphone or a combined headphone set in accordance with claim 1, wherein one of said headphone or combined headphone set includes a signal pass-through port enabling a second user to plug-in their own headphone set in order to listen to the same audio source as the first user.

* * * * *